United States Patent [19]

Bross

[11] Patent Number: 4,592,160

[45] **Date of Patent: * Jun. 3, 1986**

[54] HANDGUN MAGAZINE WITH POMMEL BASE

[76] Inventor: Robert Bross, Ballville Rd, Bolton, Mass. 01740

[ * ] Notice: The portion of the term of this patent subsequent to Jan. 29, 2002 has been disclaimed.

[21] Appl. No.: 659,329

[22] Filed: Oct. 10, 1984

[51] Int. Cl.[4] ..... F41C 25/00

[52] U.S. Cl. ..... 42/7

[58] Field of Search ..... 42/7

[56] References Cited

U.S. PATENT DOCUMENTS

| | | | |
|---|---|---|---|
| 2,205,967 | 6/1940 | Wise | 42/18 |
| 2,715,789 | 8/1955 | Garand | 42/50 |
| 2,828,568 | 4/1958 | Sakewitz | 42/7 |
| 3,143,819 | 8/1964 | Stevens, Jr. | 42/7 |
| 3,273,275 | 9/1966 | Badali | 42/50 |
| 3,372,506 | 3/1968 | Wilhelm | 42/7 |
| 3,758,978 | 9/1973 | Theodore | 42/7 |
| 3,798,818 | 3/1974 | Casull | 42/72 |
| 4,276,709 | 7/1981 | Bross | 42/71 P |
| 4,343,107 | 8/1982 | Kaltenegger | 42/7 |
| 4,397,109 | 8/1983 | Pachmayr et al. | 42/50 |
| 4,495,720 | 1/1985 | Bross | 42/7 |
| 4,514,922 | 5/1985 | Farrar et al. | 42/7 |

*Primary Examiner*—Charles T. Jordan

*Attorney, Agent, or Firm*—Hamilton, Brook, Smith & Reynolds

[57] ABSTRACT

Means for attaching a pommel to a cartridge magazine assembly which is releasably received within the grip of a handgun. The pommel (16) has a face (79) which is engageable with the base of the magazine. A plateau (87) rises from the face and has slots (100) formed in it. Complimentary flanges (54) are formed on the base of the magazine and are engageable with the slots in the plateau to join the pommel and magazine together. There are means (58) to releasably interlock the pommel and the magazine assembly when they are in assembled relationship.

12 Claims, 19 Drawing Figures

10
12
13
14
16
17
20
22
24
40
42
44
46
48
49
50
52
54
82
84
V

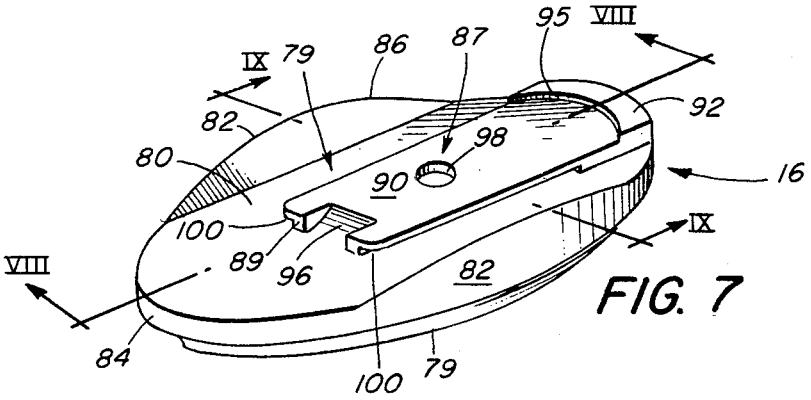
FIG. 7
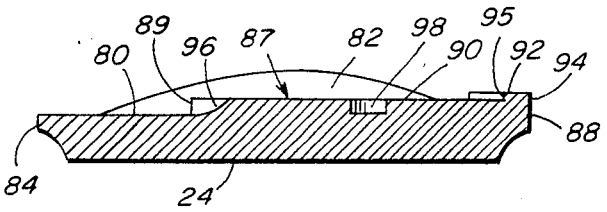
FIG. 8
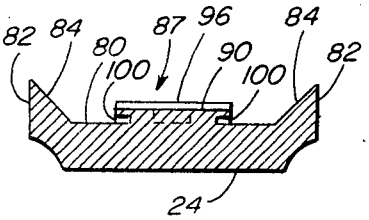
FIG. 9
FIG. 10
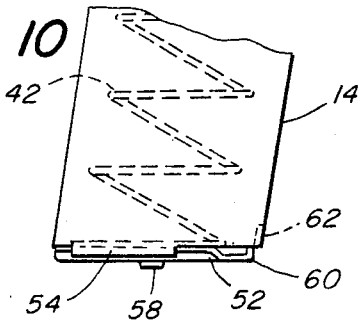
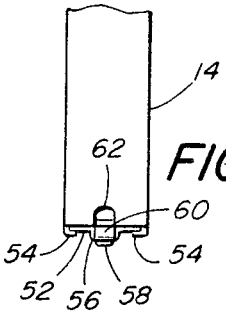
FIG. 11
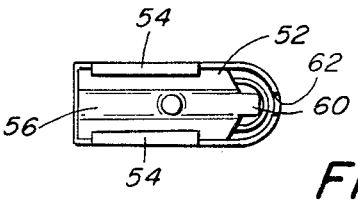
FIG. 12

HANDGUN MAGAZINE WITH POMMEL BASE

DESCRIPTION

1. Technical Field

This invention is in the field of firearms. More particularly, it relates to pommels which can be removably secured at the butt end of the grip area of handguns, particularly automatic or semiautomatic pistols which have removable magazine assemblies insertable in recesses in their grips or handles.

2. Background Art

In U.S. Pat. No. 4,276,709, Applicant disclosed a butt plate or pommel which is particularly adaptable for attachment to the stocks or grips of revolvers. The revolver pommel comprises a pommel plate having a mounting boss extending from its inner surface and means for securing it to the removable stocks of a revolver.

The pommel, once having been attached to the grip portion of the revolver, serves a number of functions. Primarily, it is decorative since it can be embossed with emblems or engraved with initials or the like. It also offers a base for an optional loop to which a lanyard may be attached. The weight of the pommel located at the butt of the revolver changes the balance of the overall revolver and also has an effect on recoil during firing.

The pommel disclosed in Applicant's prior patent is removable and readily replaceable with pommels made of other materials or having other designs or shapes depending upon the wishes of the owner. In the replacement process the stocks, which are normally fastened to the frame of the revolver by a single transverse screw, are removed. Consequently, the grip or handle of the revolver must be taken apart in order to replace the pommel.

In an automatic or semiautomatic handgun, (and for purposes of this application, the terms "automatic" and "semiautomatic" may be used interchangeably since the invention applies equally to both types of guns) on the other hand, the butt of the gun normally is to some extent the bottom base plate of the cartridge-holding magazine assembly, sometimes known as the clip. In contrast therefore to a revolver to which a pommel is attached, the pommel on an automatic gun is not attached to the stocks of the gun but is an integral, removable and replaceable part of the magazine assembly per se and thus is separated from the gun every time the magazine assembly is withdrawn. Consequently, such a pommel cannot be added to or removed from an automatic handgun as it is from a revolver in the manner disclosed by Applicant's prior patent for several reasons, one being, because automatic handguns, generally speaking, do not have a screw passing transversely through the stock and frame. In fact, if a screw were located, in this manner, passing completely through the grip of an automatic, it could make it impossible to insert the magazine assembly.

Typical magazine assemblies for automatic handguns are shown in U.S. Pat. No. 2,828,568 to Sakewitz or U.S. Pat. No. 3,143,819 to Stevens. Generally speaking, the magazine portion of a magazine assembly comprises an elongated housing, more or less rectangular in cross section, usually made of sheet metal and into which cartridges are placed. The cartridges are urged upwardly in the magazine from the bottom, generally referred to as the base, by a spring which presses a follower against the lowermost cartridge or cartridges in the magazine. The lower end of the spring abuts a bottom plate or detent plate which is removably secured to a removable base plate of the magazine assembly, generally by sliding engagement between mating flanges. Generally speaking, the base of the magazine assembly constitutes an extending, exposed, portion of the gun's butt end. It is often approximately the size of the cross section of the magazine which, in turn, fits within a recess of the grip or handle of the gun. Thus, the bottom or base plate is usually smaller than the bottom dimension of the gun grip and has little decorative effect and often no functional effect other than serving as the bottom of the magazine. It has little area to decorate or receive an emblem.

As shown in the Stevens patent, the base plate can present an interrupted surface occasionally with portions overhanging the bottom of the pistol grip or, conversely, as in Sakewitz, not coming to an end of the pistol grip.

It is one of the objects, therefore, of this invention to provide a pommel for an automatic or semiautomatic pistol which is not only functional but also affords a smooth, continuous and uninterrupted base plate for the grip profile of the pistol.

Another object of the invention is to provide a pommel for an automatic or semiautomatic handgun which is readily removable and replaceable with others of different design or appearance or with the original base plate.

In U.S. Pat. No. 4,495,720, Applicant has disclosed a functional, decorative pommel, and means for mounting it to the butt end of a magazine assembly of the type which is releasably slideable into a recess in the grip of a handgun, particularly an automatic or semiautomatic pistol. The pommel has a recessed interior and an exterior periphery which is complementary and coincident to the shape of the overall butt end of the gun. There are releasable interlock means on the butt end of the magazine and complementary releasable interlock means within the confines of the recessed interior of the pommel. The pommel and the magazine may be secured together with the interlock means completely obscured from view when the magazine is inserted into the grip of the handgun.

The pommel itself is a plate having a continuous exterior wall coincident to the shape of the butt of the grip of a handgun. The interior recess in the pommel plate is defined by the interior surface of the wall. Longitudinal slots are formed in the wall and longitudinal flanges are formed at the butt end of the magazine assembly. The slots and the flanges are arranged with mating interruptions in staggered relationship to permit the butt end of the magazine assembly to enter the interior recess and to align the flanges with the slots to attach the pommel to the magazine by sliding engagement. Releasable detent means are provided to maintain the magazine assembly and the pommel in an assembled relationship.

Applicant's present invention is directed to pommels which do not necessarily have recessed interiors or require mating interruptions in the pommel and the magazine assembly.

DISCLOSURE OF THE INVENTION

The invention resides in a means for attaching a pommel to a cartridge magazine assembly which is slideable into the recess of the butt end of a grip or handle of an automatic or semiautomatic handgun. The magazine assembly has a cartridge discharge end into which cartridges are loaded and from which they are discharged in the firing process, and an end, herein called the base which is normally considered to be the closed end in that cartridges are not discharged from it, and the magazine has a removeable base plate, the pommel has a face which is engageable with the base of the magazine assembly. A floor forms part of the face and rising from the floor is a plateau. The plateau extends from one end of the pommel and terminates in a wall which is spaced from the opposite end of the pommel. Slots are formed in the plateau beginning at the wall and extending toward the opposite end of the pommel. Complimentary flanges are located on the base of the magazine and are engageable with the slots in the plateau to join the pommel and the magazine together. Means, in the form of a spring biased detent and hole are located on the magazine and pommel respectively to releasably interlock the magazine assembly and pommel when they are in assembled relationship.

The flanges on the magazine are complementary to the slots in the pommel and may extend inwardly or outwardly in a direction reverse to the slots. The plateau may assume different configurations and the slots may extend either inwardly or outwardly thereof.

The pommel is releasable from the magazine assembly by withdrawing the detent from its receiving hole, in order to remove and or replace it or to replace it with the original base plate.

The above and other features of the invention including various novel details of construction and combinations of parts will now be more particularly described with reference to the accompanying drawings and pointed out in the claims. It will be understood that the particular handgun pommel attaching means embodying the invention is shown by way of illustration only and not as a limitation of the invention. The principles and features of this invention may be employed in varied and numerous embodiments without departing from the scope of the invention.

DESCRIPTION OF THE DRAWINGS

FIG. 7 is a perspective view of one embodiment of a pommel plate mode in accordance with this invention.

FIG. 8 is a sectional view of the pommel of FIG. 7 taken along the lines VIII—VIII on FIG. 7.

FIG. 9 is a sectional view of the pommel of FIG. 7 taken along the lines IX—IX on FIG. 7.

FIG. 10 is a side elevational view of the base or closed end of a cartridge magazine assembly with the original base plate reworked and which receives the pommel of FIG. 7.

FIG. 11 is a front elevational view of the magazine of FIG. 10.

FIG. 12 is a bottom plan view of the detent plate of the magazine of FIG. 10.

BEST MODE OF CARRYING OUT THE INVENTION

Figures 1, 2, 3, 4, 5, 6:
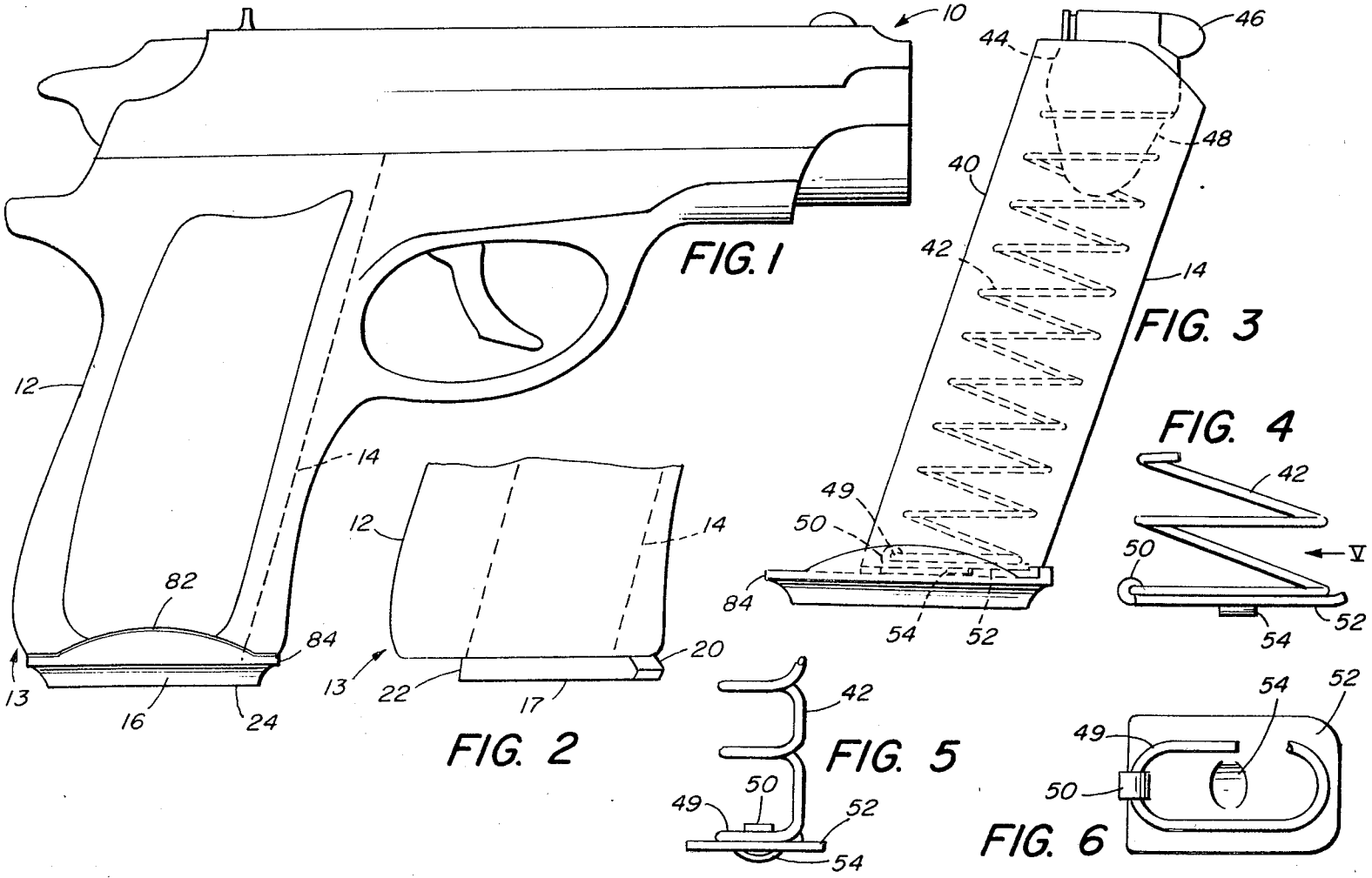
FIG. 1 is a side elevational view of an illustrative automatic or semiautomatic handgun having a pommel at the butt end of its grip or handle made and mounted in accordance with this invention.
FIG. 2 is a partial side elevational view of a typical handgun having a magazine assembly with a base plate of conventional construction. It may be considered prior art.
FIG. 3 is a side elevational view of a cartridge magazine assembly or clip for the handgun shown in FIG. 1.
FIG. 4 is a side elevational view on a slightly enlarged scale of a typical spring and detent plate for a magazine.
FIG. 5 is a front elevational view taken in the direction of the arrow V on FIG. 4 of the spring and detent plate.
FIG. 6 is a top plan view of the detent plate of the magazine assembly.

In FIG. 1 there is disclosed an automatic or semiautomatic pistol 10 typical of many handguns. It includes a grip area or handle designated generally as 12 and includes a magazine assembly 14 having at its base or butt end, a pommel 16 embodying features of the invention. The upper or discharge end of the magazine is inserted into a recess in the butt end of the grip 12 with the pommel interfacing the butt end 13 of the grip.

In FIG. 2 there will be seen what may be considered prior art. The base plate 17 has a leading end 20 extending slightly beyond the profile of the grip 12 and an end 22, terminating short of the grip profile. This may be considered unattractive although there may be functional reasons for this type of construction, for example, the attachment of a lanyard loop.

A typical magazine assembly 14 will now be described with reference to FIGS. 3 to 6. It includes a magazine in the form of a tubular column 40 of generally rectangular cross section and includes a compression spring 42. At the upper end of the spring is a conventional follower 44, the upper portion of which is contoured to engage a cartridge 46. The lower portion of the follower has a tang 48 which descends into the uppermost coil or coils of the spring. The lower end of the spring 42 has a terminal end 49 and as seen in FIGS. 5 and 6 engages beneath a curled-up tongue 50 extending upwardly from a detent plate 52. This portion of the magazine may be considered the base or closed end. A detent 54 is pressed from the top out through the bottom of the plate 52 or may, for example, be a separate member secured to the plate 52.

Referring next to FIGS. 7, 8 & 9, one embodiment of the pommel plate 16 will now be described. As seen in FIG. 7, it is generally oval or elongated in configuration, but more importantly its circumference is formed complementary and coincident to the shape of the gun butt end 13 or bottom of the grip area. When the whole magazine assembly is inserted into the recess in the grip, the pommel 16 interfaces with the grip to give a smooth continuous line as seen in side elevation in FIG. 1 as distinguished from FIG. 2. The lower surface 24 of the pommel is generally planar, smooth, continuous and uninterrupted, but it may be contoured or engraved or have a decorative or symbolic emblem secured to it. It may also be interrupted to permit access to features of the gun, for example a permanently attached lanyard loop.

The pommel has a face generally indicated 79 engageable with the butt end of the grip. The face has a flat floor 80. Extending lengthwise of the elongated pommel 16 and rising from the floor 80 is a pair of lips 82. They are integrated with and form a part of a continuous peripheral wall 84. The lips have inwardly sloping surfaces 86 to mate with corresponding surfaces on the gun grip (not seen). Also rising from the floor is an elongated plateau 87 extending from the peripheral front edge 88 of the pommel and terminating short of the opposite end in a vertical wall 89. The plateau has a flat upper surface 90. A curved wall 92 rises from the top surface 90 of the plateau at the front edge 88 and has an arcuate portion 94 (FIG. 8) contiguous and integral with the peripheral front edge 88, also including the lips 82. The wall 92 has an inner arcuate vertical surface 95.

An inclined ramp 96 is formed in the rear wall 89 of the plateau and intersects the upper surface 90. A detent receiving hole 98 is formed in the upper surface 90 of the plateau. Below the surface 90 and running along the long sides, lengthwise of the plateau, to a point just short of the vertical surface 95, are a pair of outwardly opening slots 100.

The magazine assembly 14 and the detent plate 52 will now be described in more detail with reference to FIGS. 10, 11 & 12. The lower end of the spring 42 urges detent plate 52 downwardly of the magazine 14 against a pair of inwardly extending flanges 54 which prevent the detent plate from coming out of the magazine. The detent plate 52 has a longitudinal ridge 56 extending down the center and a detent 58 projects downwardly from the ridge. The right hand end of the ridge as viewed in FIGS. 10 and 12, has an upturned lip 60, and when in assembled relationship in the magazine, is aligned with an access slot 62 in the base or lower end of the magazine 14 to permit access to the detent plate for purposes of removing the pommel 16 from the magazine assembly.

The magazine assembly 14 and the pommel 16 are assembled as follows. The detent plate 52 is pressed against the plateau 87 with the detent 58 aligned with the ramp 96. The magazine assembly 14 and the pommel 16 are urged mutually together with the detent 58 riding up the ramp 96 and with the flanges 54 on the magazine 14 entering the slots 100 in the pommel. The detent 58 moves across the flat upper surface 90 until it drops into the detent hole 98 and magazine 14 engages the arcuate vertical surface or wall 95 to assemble the parts together.

The magazine assembly with the pommel attached may then be inserted into the recess in the grip of the gun with the periphery of the pommel and its lips 88 creating a smooth, cosmetically finished, blended interface with the lower butt end of the grip area of the gun as shown in FIG. 1.

With the magazine assembly removed from the gun, the pommel 16 and magazine assembly 14 may be disassembled. A tool is inserted in the access 62 to engage the underside of the lip 60 to raise the detent 58 from the hole 98 in the plateau. The magazine and pommel may then be separated by sliding them apart in the reverse direction from which they were assembled.

Figure 13:
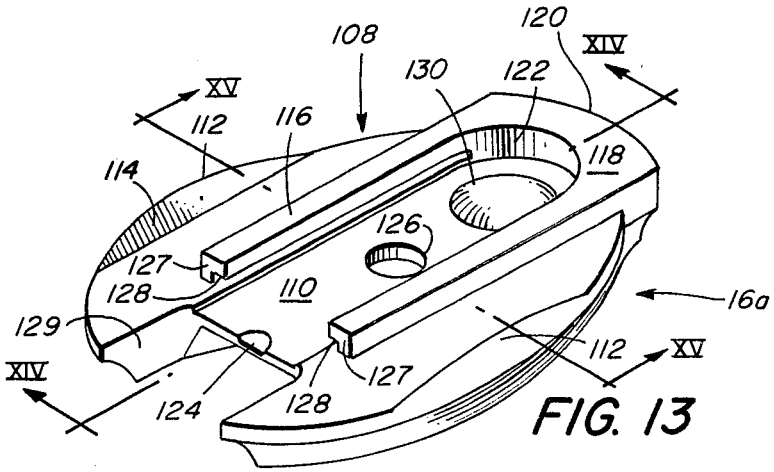
FIG. 13 is a perspective view of another embodiment of the pommel plate made in accordance with this invention.
Figure 14:
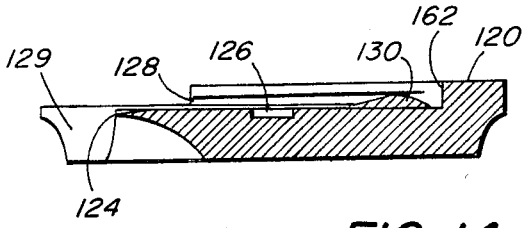
FIG. 14 is a sectional view of the pommel of FIG. 13 taken along the lines XIV—XIV on FIG. 13.
Figure 15:
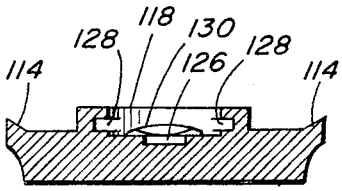
FIG. 15 is a sectional view of the pommel of FIG. 13 taken along the lines XV—XV on FIG. 13.
Figure 16:
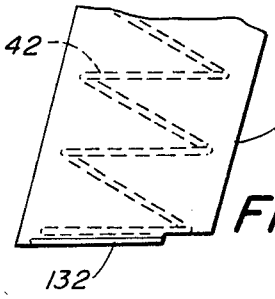
FIG. 16 is a side elevational view of the base or closed end of a cartridge magazine assembly which receives the pommel of FIG. 13 and with the detent plate removed.
Figure 17:
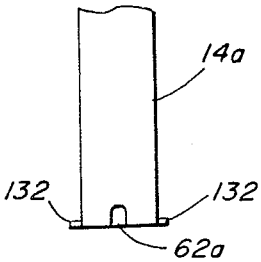
FIG. 17 is a front elevational view of the magazine of FIG. 16.
Figure 18:
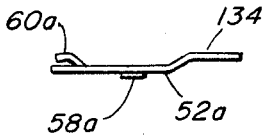
FIG. 18 is a side elevational view of the detent plate of the magazine of FIG. 16; and, FIG. 19 is a bottom plan view of the detent plate of FIG. 18.
Figure 19:
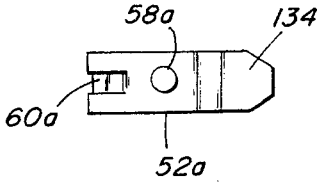

An alternative embodiment of the pommel (**16*a*) will now be described with reference to FIGS. 13, 14 & 15. As in the FIG. 7 embodiment, the pommel 16*a* has a face generally indicated 108. In the face is a slightly indented flat floor 110. Extending latterally of the pommel 16*a* and rising from the face 108 are a pair of lips 112. The lips have inwardly sloping surfaces 114**.

Also as in the FIG. 7 embodiment, rising above the floor is a plateau 116 having a flat upper surface 118 and an arcuate wall 120 (FIG. 14) at its front end including an inner arcuate vertical surface face 122. The plateau terminates short of the opposite end in a wall 127. An inclined ramp 124 is formed in the left hand or rear edge of the flat surface 110 at the end opposite the arcuate face 122. A detent receiving hole 126 is formed in the flat surface 110. Beneath the upper surface 118 of the plateau 116 and running lengthwise of the plateau to a point just short of the wall 122 are a pair of inwardly facing slots 128. An elevated dome 130 rises from the surface 110 between the detent hole 126 and the face 122.

The pommel **16*a* is interrupted by a notch-like configuration 129** to permit access to features of the gun, as for example a permanently attached lanyard loop.

The magazine assembly **14*a* and the detent plate 52*a* will now be described in more detail with reference to FIGS. 16 through 19. The lower end of the spring 42 urges the detent plate downwardly of the magazine. A pair of outwardly extending flanges 132 are formed at the lower end or base of the magazine 14*a*. The bottom of the plate 52*a* has a raised forward step 134 and a downward extending detent 58*a*. The left hand or rearward end of the plate 58*a* (as viewed in FIGS. 18 and 19) has an upturned spring retaining lip 60*a*, and when the magazine assembly 14*a* has received, the pommel 16*a* the lip 60*a* is aligned with a slot 62*a* in the lower end of the magazine 14*a*** to facilitate entry of a tool to initiate removal of the pommel if desired as will be described hereinafter.

The magazine **14*a* and the pommel 16*a* are assembled as follows: The detent plate 52*a* is pressed into the magazine while the detent 58*a* is aligned with the ramp 124. The magazine 14*a* and the pommel 16*a* are urged mutually together with the detent riding up the ramp 124 with the flanges 132 on the magazine 14*a* entering the slots 128 in the pommel 16*a*. The detent moves across the flat floor 110 until it drops, under spring pressure into the detent hole 126 and the right hand (as seen in the Figures) or forward rounded end of the magazine abuts the surface 122 of the wall 120. The forward step 134 of the detent plate rides up and is supported by the dome 130. The detent 58*a* drops into the hole 126** to assemble these parts together.

As with the FIG. 7 configuration, the magazine assembly, with pommel attached, may then be inserted into the recess in the grip of the gun with the lips 112 of the pommel forming a smooth blended interface with the lower or butt end surfaces of the grip of the gun.

With the magazine removed from the gun, the pommel **16*a* and the magazine assembly 14*a* may be disassembled. A tool is inserted in the access notch 62*a* in the magazine assembly 14*a* to engage the underside of the lip 60*a* of the detent plate 52*a* to raise the detent 58*a* from the hole 126** in the pommel. The magazine and pommel may then be slid apart in the reverse direction from which they were assembled.

I claim:

1. Means for attaching a pommel to a cartridge magazine assembly which is slideable into a recess in a butt end of a grip of a handgun, the magazine having a cartridge discharge end and a base, the pommel having a face engageable with the base of the magazine assembly, a floor forming part of the face, a plateau rising above the floor, slots formed in the plateau, complementary flanges on the base of the magazine assembly engageable with the slots in the plateau to join the pommel and magazine assembly together; and, means to releasably interlock the magazine assembly and pommel when in assembled relationship.

2. Attaching means according to claim 1, in which the flanges in the magazine assembly extend outwardly and the slots in the plateau extend inwardly.

3. Attaching means according to claim 1 in which the flanges on the magazine assembly extend inwardly and the slots in the plateau extend outwardly.

4. Attaching means according to claim 1 in which the releasable interlock means includes a spring biased detent on the magazine assembly and a detent receiving hole in the pommel.

5. Means for attaching a pommel to the butt end of a grip of a handgun of the type having a cartridge magazine assembly insertable in a recess in the butt end of the grip, the magazine assembly having a cartridge discharge end and a base, the pommel having a face engageable with the base of the magazine assembly, a floor forming part of the face, a plateau rising above the floor, lips on the face spaced laterally of the plateau and formed complementary to surfaces of the butt end of the grip of the handgun, slots formed in the plateau, complementary flanges on the base of the magazine assembly engageable with the slots in the plateau to join the pommel and magazine assembly together; and, means for releasably interlocking the magazine assembly and pommel together when in assembled relationship.

6. Attaching means according to claim 5 in which the flanges in the magazine assembly extend outwardly and the slots in the plateau extend inwardly.

7. Attaching means according to claim 5 in which the flanges on the magazine assembly extend inwardly and the slots in the plateau extend outwardly.

8. Attaching means according to claim 5 in which the releasable interlock means includes a spring biased detent on the magazine assembly and a detent receiving hole in the pommel.

9. Means for attaching a pommel to a butt end of a grip of a handgun of the type having a cartridge magazine assembly insertable in a recess in the butt end of the grip, the magazine assembly having a cartridge discharge end and a base;

the pommel having a face engageable with the base of the magazine assembly, a floor forming part of the face, a plateau rising above the floor and extending from one end of the pommel, and terminating in a wall which is spaced from the opposite end of the pommel, slots formed in the plateau beginning at the wall and extending toward said one end of the pommel; and, complementary flanges on the base of the magazine assembly engageable with the slots in the plateau to releasably interlock the magazine and pommel together when in assembled relationship, whereby the pommel and magazine assembly may be assembled by sliding the flanges of the magazine assembly into the slots beginning at the wall.

10. Attaching means according to claim 9 in which the flanges in the magazine assembly extend outwardly and the slots in the plateau extend inwardly.

11. Attaching means according to claim 9 in which the flanges on the magazine assembly extend inwardly and the slots in the plateau extend outwardly.

12. Attaching means according to claim 9 in which the releasable interlock means includes a spring biased detent on the magazine assembly and a detent receiving hole in the pommel.

* * * * *